United States Patent [19]

Ueda et al.

[11] Patent Number: 4,865,934

[45] Date of Patent: Sep. 12, 1989

[54] FUCTION DIVIDED PHOTOSENSITIVE MEMBER

[75] Inventors: Hideaki Ueda; Mitsutoshi Sakamoto; Kimiyuki Ito, all of Osaka, Japan

[73] Assignee: Minolta Camera Kabushiki Kaisha, Osaka, Japan

[21] Appl. No.: 184,630

[22] Filed: Apr. 22, 1988

[30] Foreign Application Priority Data

Apr. 24, 1987 [JP] Japan ..... 62-102865
May 6, 1987 [JP] Japan ..... 62-111426

[51] Int. Cl.[4] ..... G03G 5/06; G03G 5/14

[52] U.S. Cl. ..... 430/59; 430/78; 430/96

[58] Field of Search ..... 430/58, 59, 78, 96

[56] References Cited

U.S. PATENT DOCUMENTS

| | | | |
|---|---|---|---|
| 3,189,447 | 6/1965 | Neugebauer et al. . | |
| 3,820,989 | 6/1974 | Rule et al. . | |
| 3,873,312 | 3/1975 | Contois et al. . | |
| 3,972,717 | 8/1976 | Weidmann . | |
| 4,045,220 | 8/1977 | Contois et al. . | |
| 4,105,447 | 8/1978 | Fox . | |
| 4,334,001 | 6/1982 | Horie et al. | 430/83 |
| 4,362,798 | 12/1982 | Anderson et al. | 430/59 |
| 4,399,208 | 8/1983 | Takasu et al. | 430/59 |
| 4,420,548 | 12/1983 | Sakai et al. | 430/59 |
| 4,606,988 | 8/1986 | Sasaki | 430/59 |
| 4,619,879 | 10/1986 | Kakuta et al. | 430/58 |
| 4,622,278 | 11/1986 | Kondo et al. | 430/59 |
| 4,642,280 | 2/1987 | Ueda | 430/73 |

FOREIGN PATENT DOCUMENTS

| | | | |
|---|---|---|---|
| 56-50333 | 5/1981 | Japan | 430/46 |
| 58-65441 | 4/1983 | Japan | 430/58 |
| 58-98736 | 6/1983 | Japan . | |
| 58-160957 | 9/1983 | Japan | 430/58 |
| 60-19151 | 1/1985 | Japan | 430/59 |
| 60-19154 | 1/1985 | Japan | 430/78 |
| 60-232553 | 11/1985 | Japan | 430/58 |
| 61-43754 | 3/1986 | Japan | 430/59 |
| 62-38472 | 2/1987 | Japan | 430/58 |
| 62-272272 | 11/1987 | Japan | 430/96 |

*Primary Examiner*—Roland E. Martin
*Attorney, Agent, or Firm*—Burns, Doane, Swecker & Mathis

[57] ABSTRACT

The present invention relates a photosensitive member which has a charge generating layer comprising specific phthalocyanine as a charge generating material and specific resin as a binder, and/or a charge transporting layer comprising specific hydrazone compounds as a charge transporting material and dyes as an absorbent for undesired lights.

5 Claims, 3 Drawing Sheets

FUCTION DIVIDED PHOTOSENSITIVE MEMBER

BACKGROUND OF THE INVENTION

A photosensitive material forming a photosensitive member, inorganic photoconductive materials such as selenium, cadmium sulfide or zinc oxide have been known.

These photosensitive materials have such many advantages that those materialis can be charged to adequate potential, the loss of charges in the dark is low, the electrical charge can be dissipated fast with irradiation of light and so on. However, they have disadvantages as follows. For example, a photosensitive member based on selenium has difficulty in its production, high production costs and difficult handling due to inadequate resistivity to heat or mechanical impact. A photosensitive member based on cadmium sulfide or zinc oxide has such defects as its unstable sensitivity in a highly humid environment and less stability with time because of the deterioration of dyestuffs added as a sensitizer by corona charge and fading with exposure.

On the other hand, many kinds of organic photoconductive materials such as polyvinylcarbazole and so on have been proposed. These organic photoconductive materials are superior in film forming properties, lightness in weight, etc., but inferior in sensitivity, durability and environmental stability to aforementioned inorganic photoconductive materials.

Various studies and developments have been in progress to overcome the above defects and problems, and a function-divided photosensitive member of a laminated type or a dispersed type has been proposed in which charge generating function and charge transporting function are divided by different layers or different dispersed materials. The function-divided photosensitive member can be a highly efficient photosensitive member in electrophotographic properties such as chargeability, sensitivity, residual potential, durability against copy and repetition because most adequate materials can be selected from among various kinds materials. Further, the function-divided photosensitive member has high productivity and low costs, since it can be prepared by coating, and adequately selected charge generating materials can freely control a region of photosensitive wavelength. Illustrative examples of such charge generating materials are organic pigments or dyes such as phthalocyanine pigment, cyanine pigment, polycyclic quinone pigment, perylene pigment, indigo dye, thioindgo dye, squaraine compounds, etc.

In particular, a phthalocyanine pigment is useful as a charge generating material to a laser printer of electrophotographic type furnished with laser light as light source, which is one kind of high speed printers. Among phthalocyanine pigments which have high sensitivity in the range of long wavelength, metal-free phthalocianine pigments such as $\tau$-form, modified-$\tau$-form, $\eta$-form, and modified-$\eta$-form are disclosed in Japanese Patent KOKAI Nos. 18263/1983, 19147/1985 or 19153/1985. Japanese Patent KOKAI No. 19147/1985 discloses a photosensitive member in which a charge generating layer comprises $\tau$-form or modified-$\tau$-form phthalocyanine at a ratio of $\frac{1}{3}$–3/1 to silicon resin. Such photosensitive member, although, have not enough static characteristics, and more sensisitive improvement is desired.

On the other hand, a function divided photosensitive member in which a charge transporting layer is comprised of hydrazone compounds generally used as charge transporting materials brings about such problems as the deteriorations of chargeability and the increment of residual potential when left alone in the light. The properties in the light are liable to be deteriorated when a photosensitive member is exposed to light for its installation in a copying machine or the maintenance of a copying machine. Some photosensitive members are deteriorated by the repeated irradiations of erasing light in a copying machine.

It is conventionally thought that the light deterioration is caused by ultraviolet light in the range of 450 nm or less. From the view point, photosensitive member containing a ultraviolet absorber or a dye which absorbs ultraviolet light of 450 nm or less are disclosed in Japanese Patent KOKAI Nos. 120260/1983, 163945/1983, 163946/1983 and so on.

But, the overcome of light deteriorations requires a large amount of dyes, which prevent the movement of carriers and causes the decrease of charge mobility in a charge transporting layer.

SUMMARY OF THE INVENTION

The object of the invention is to provide a photosensitive member excellent in whole static properties, in particular, sensitivity.

The another object of the invention is to provide a photosensitive member which does not undergo light deterioration in sensitivity and chargeability even after used repeatedly or for a long time.

The another object of the invention is to provide a photosensitive member with good image properties comprising a charge generating layer excellent in dispersibility and application properties.

The present invention relates to a function-divided photosensitive member which have a charge generating layer and a charge transporting layer on an electrically conductive substrate, wherein the charge generating layer comprises polyvinyl butyral and metal-free phthalocyanine selected from the group consisting of $\tau$-form, modified $\tau$-form, $\eta$-form, modified $\eta$-form and a mixture thereof and/or the charge transporting layer comprises a hydrazone compound represented by the following general formula (I) and a dye which have the light absorbing maximum in the range of 450–500 nm;

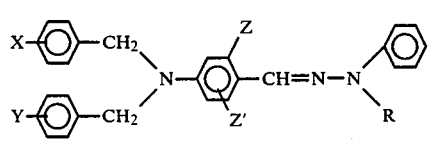

[I]

wherein X and Y independently represent hydrogen, a lower alkyl group, a methoxy group or an ethoxy group, Z represents a lower alkyl group, a benzyl group, a lower alkoxyl group, a phenoxy group or a benzyloxy group, Z' represents hydrogen, an alkyl group or an alkoxy group, R represents a lower alkyl group, an aryl group which may have substituents or a benzyl group.

BRIEF DESCRIPTION OF THE INVENTION

DETAILED DESCRIPTION OF THE INVENTION

Figure 1:
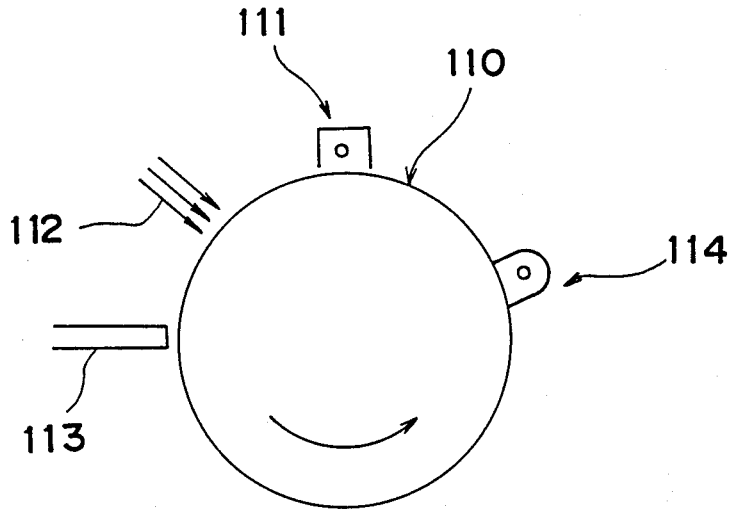
FIG. 1 is a schematic view of a tester for a photosensitive member.
Figure 2:
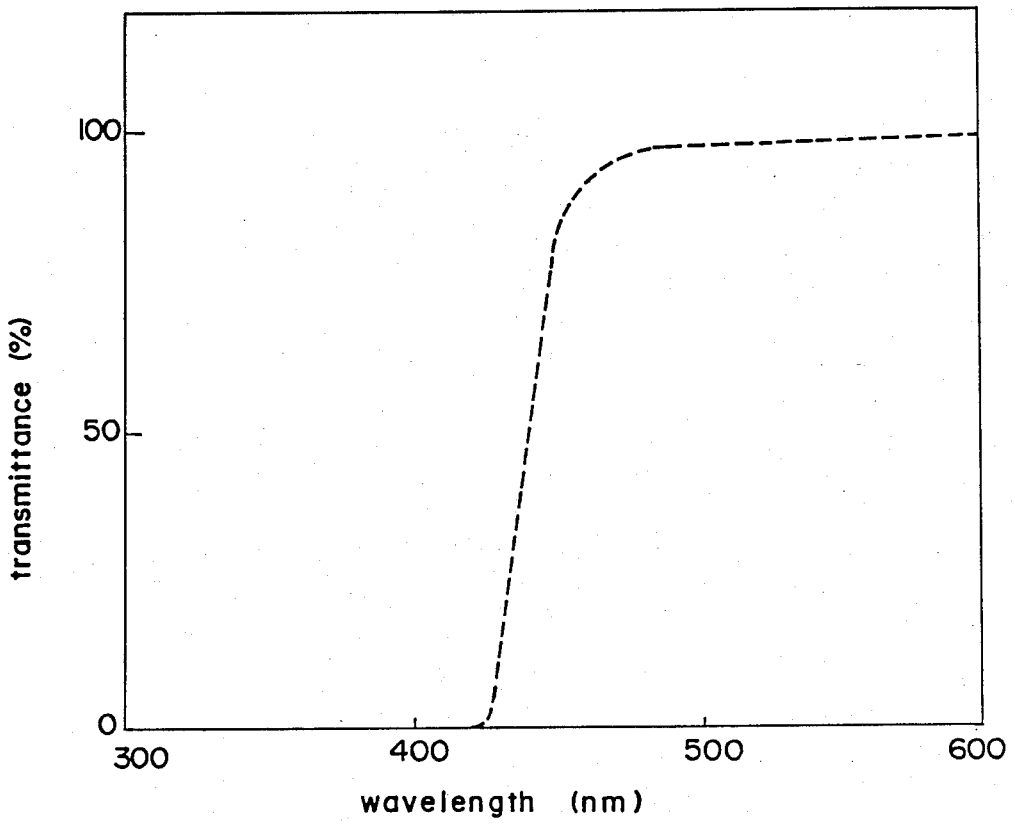
FIG. 2 shows the transmittance of the charge transporting layer containing hydrazone compound (1), prepared in Example 9.

A function-divided photosensitive member has at least a charge generating layer and a charge transporting layer on an electrically conductive substrate.

(CHARGE GENERATING LAYER)

A charge generating layer may be formed by the vapor deposition of photoconductive materials or the application and drying of a dispersion solution of photoconductive materials and, if desired, binder resin in an adequate solvent.

Examples of charge generating materials include organic compounds such as bisazo pigments, triarylmethane dyes, thiazine dyes, oxazine dyes, xanthene dyes, cyanine pigments, styryl pigments, pyrylium dyes, azo pigment, quinacridone pigments, indigo pigments, perylene pigments, polycyclic quinone pigments, bisbenzimidazole pigments, indanthrone pigments, squaraine pigments, azulene pigments, phthalocyanine pigments and so on, and inorganic pigments such as selenium, selenium-tellurium, selenium-arsenic, cadmium sulfide, selenium-cadmium, zinc oxide, amorphous silicon and so on. Other materials which can absorb light to generate charge carriers at high efficiency may be used.

Preferred charge generating materials are phthalocyanine pigments such as titanyl phthalocyanines represented by the following general formula (II) and metal-free phthalocyanine including $\tau$-form, modified $\tau$-form, $\eta$-form, modified $\eta$-form and mixture thereof.

(II)

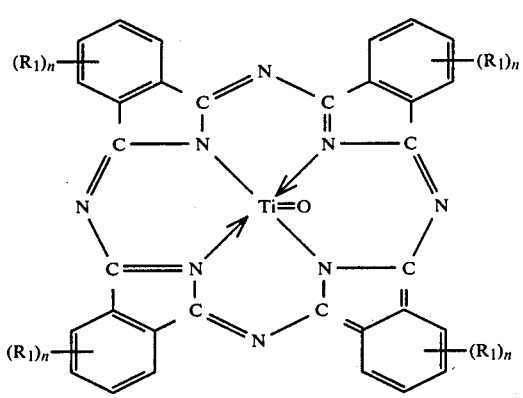

wherein $R_1$ represents hydrogen, a lower alkyl 9roup, a lower alkoxy group, an aryloxy group, a nitro group, a cyano group, a hydroxy group, a benzyloxy group or halogen atoms and n represents an integer of 1–4.

Examples of binder resin for the formation of a charge generating layer are polyester resin, polyarylate resin, polycarbonate resin, polyvinyl butyral, polyvinyl alcohol, phenoxy resin, methacrylate resin and mixture thereof and so on.

The combination of metal-free phthalocyanine selected from the group consisting of $\tau$-form, modified $\tau$-form, $\eta$-form, modified $\eta$-form and a mixture thereof as a charge generating material and polyvinyl butyral, as binder resin makes possible to provide a charge generating layer particularly excellent in sensitive properties and the dispersibility of a charge generating materials. The other combinations have possibility to impair the properties such as dark decay of charges and sensitivity and so on.

Metal-free phthalocyanine of $\tau$-form, modified $\tau$-form, $\eta$-form, modified $\eta$-form are disclosed in detail in Japanese Patent KOKAI Nos. 182639/1983, 19153/1985, etc.

Metal-free phthalocyanine of $\tau$-form have the diffraction pattern showing strong lines in Bragg's angles ($2\theta+0.2°$) of 7.6, 9.2, 16.8, 17.4, 20.4 and 20.9 with X-ray of 1.541λ of $CuK\alpha_1$/Ni. Preferred metal-free phthalocyanine of $\tau$-form is the one such that the infrared absorption spectrum shows with four absorp-bands in the range of 700–760 $cm^{-1}$ among which the absorp-band of 751±2 cm strongest, two absorp-bands of almost same strength in the range of 1320–1340 $cm^{-1}$ and one absorp-band in 3288±3 $cm^{-1}$.

A typical production method of metal-free phthalocyanine of $\tau$-form is characterized by stirring or milling metal-free phthalocyanine of o-form with enough mechanical shearing force for enough time at the temperature of 50°–180° C., preferably, 60°–130° C. to show phthalocyanine of $\tau$-form. By the way, the expressions of X-ray diffraction spectrum and infrared absorption spectrum are given a little wide range because of a little different spectrums dependent on lattice defects or dislocations in the crystal according to different conditions of the production.

Metal-free phthalocyanine of o-form, being a raw material of metal-free phthalocyanine of $\tau$-form, can be prepared in per se known manner and another adequate manner, for example, according to Moser and Thomas, "Phthalocyanine Compounds". For example, metal free phthalocyanine can be prepared by the treatment of metal phthalocyanine such as lithium phthalocyanine, sodium phthalocyanine, calcium phthalocyanine, magnesium phthalocyanine and so on with acids such as sulfuric acid to remove the metals or by the direct synthesis from phthalodinitrile, amino imino isoindolenine or alkoxy imino isoindolenine. Preferred metal-free phthalocyanine is redeposited or hydrolyzed by pouring a solution containing dissolved metal-free phthalocyanine in acid such as sulfuric acid, or acid salts such as sulfuric acid of metal-free phthalocyanine into water, preferably, ice water. Metal-free phthalocyanine of $\alpha$-form is stirred or milled under dried condition or water-paste condition. Examples of dispersion media are glass beads, steel beads, alumina balls, flint stones and so on, which are generally used for dispersion, emulsification or mixing of pigments. The dispersion media are not necessarily needed. Examples of assistants for attrition are sodium chloride, sodium bicarbonate, milabilite and so on, which are generally used for dispersion for pigments. If dispersion solvent is needed when stirring or milling, any solvents which are liquid at the temperature of the milling or stirring may be used. Illustrative examples of dispersion solvents are alcohols such as glycerol, ethylene glycol, diethylene glycol and so on, Cellosolve series such as ethylene glycol monomethyl ether, ethylne glycol monobutyl ether and s on ketones, and ester ketones.

As to machines for stirring or milling used in crystalline dislocation process, a sand mill, a kneader, a homomixer, an agitator, a stirrer, Banbury mixer, a ball mill, an attritor and so on may be used.

The temperature in crystalline dislocation process is within the range of 50°-180° C., preferably, 60°-130° C. The usage of crystalline seeds is useful as similarly as a general crystalline dislocation process.

The crystalline dislocation speed of $\alpha$-form to $\tau$-form is dependent on various conditions such as milling efficiency, shearing forces, particle sizes of raw materials, temperature, etc. After a crystalline dislocation process, the assistants for attrition and the dispersion solvent are removed to obtain dried $\tau$-form phthalocyanine of the invention by means of general purifying method.

Metal-free phthalocyanine of modified $\tau$-form have the diffraction pattern showing strong lines in Bragg's angles ($2\theta\pm0.2°$) of 7.5, 9.1, 16.8, 17.3, 20.3, 20,8, 21.4 and 21.7 with X-ray of 1.541λ of CuK$\alpha_1$/Ni. Preferred metal-free phthalocyanine of modified $\tau$-form is the one such that the infrared absorption spectrum shows with four absorp-bands in the range of 700-760 $cm^{-1}$ among which the absorp-band of $753\pm2$ $cm^{-1}$ is strongest, two absorp-bands of almost same strength in the range of 1320-1340 $cm^{-1}$ and one absorp-band in $3297\pm3$ $cm^{-1}$.

Metal-free phthalocyanine of modified $\tau$-form can be prepared in a similar way as metal-free phthalocyanine of $\tau$-form.

Metal-free phthalocyanine of $\eta$-form can be prepared as similar way as the preparation of $\tau$-form metal-free phtalocyanine by stirring or milling of a mixture of 100 parts by weight of metal free phthalocyanine, particularly, $\alpha$-form metal-free phthalocyanine with 50 parts by weights or less of metal-free phthalocyanine which may have substituents in benzene rings, metal phthalocyanine which may have substituents in benzene rings, or mixture thereof at the temperature of 30°-220° C., preferably 60°-130° C. Metal-free phthalocyanine of $\eta$-form of the invention may include not only pure metal-free phthalocyanine but also a mixture thereof with other kinds of phthalocyanine.

Metal-free phthalocyanine of $\eta$-form of the invention is the one such that the infrared absorption spectrum shows with four absorp-bands in the range of 700-760 $cm^{-1}$ among which the absorp-band of $753\pm1$ $cm^{-1}$ is strongest, two absorp-bands of almost same strength in the range of 1320-1340 $cm^{-1}$ and one absorp-band in $3285\pm5$ $cm^{-1}$. Metal-free phthalocyanine of $\eta$-form may have the diffraction pattern showing strong peaks in Bragg's angles ($2\theta\pm0.2°$) of 7.6, 9.2, 16.8, 17.4 and 28.5 with X-ray of 1.541λ of CuK$\alpha_1$/Ni or the diffraction pattern showing strong peaks in Bragg's angles ($2\theta\pm0.2°$) of 7.6, 9.2, 16.8, 17.4, 21.5 and 27.5 with X-ray of 1.541λ of CuK$\alpha_1$/Ni The illustrative examples of the substituents of phthalocyanine as above mentioned may include an amino group, a nitro group, an alkyl group, an alkoxy group, a cyano group, a mercapto group, halogen atoms, a sulfone group, a metal salt thereof, a carboxyl group, a metal salt thereof, an ammonium group, an amine salts and so on. Various kinds of substituents may be introduced to benzene rings through an alkylene group, a carbonyl group, an imino group. The aforementioned metal-free phthalocyanine may be used conjointly with prevention agents of flocculation, crystal growth or crystal dislocation, which are known in the fields of phthalocyanine pigments (for example, the one disclosed in U.S. Pat. No. 4,088,507).

Metal-free phthalocyanine of modified $\eta$-form can be prepared is a similar way as metal-free phthalocyanine of $\eta$-form. Metal-free phthalocyanine of modified $\eta$-form of the invention is the one such that the infrared absorption spectrum shows with four absorp-bands in the range of 700-760 $cm^{-1}$ among which the absorp-band of $753\pm1$ $cm^{-1}$ is strongest, two absorp-bands of almost same strength in the range of 1320-1340 cm and one absorp-band in $3297\pm3$ $cm^{-1}$. Metal-free phthalocyanine of modified $\eta$-form may have the diffraction pattern showing strong peaks in Bragg's angles ($2\theta\pm0.2°$) of 7.5, 9.1, 16.8, 17.3, 20.3, 20.8, 21.4, and 27.5 with X-ray of 1.541λ of CuK$\alpha_1$/Ni or the diffraction pattern showing strong peaks in Bragg's angles ($2\theta\pm0.2°$) of 7.5, 9.1, 16.8, 17.3, 20.3, 20.8, 21.4, 22.1, 27.4 and 28.5 with X-ray of 1.541λ of CuK$\alpha_1$/Ni.

Metal-free phthalocyanine of $\eta$-form and modified $\eta$-form have good crystallizability. good heat resistance and the stability of the crystals in aromatic solvents. They are suitable for a photosensitive member for semiconducting laser on account of the maximum sensitivity in the range of 790-810 nm in wavelength.

Polyvinyl butyral, which is most suitable for binder resin for metal-free phthalocyanine of $\tau$-form, modified $\tau$-form, $\eta$-form, modified $\eta$-form and a mixture thereof as charge generating materials, can be prepared by saponifying polyvinyl acetate resin, followed by its condensation with butylaldehyde. The excellent dispersibility of phthalocyanine as above mentioned in polyvinyl butyral makes it possible to provide a uniformly coated charge generating layer. A laser printer equipped with a photosensitive member constituted of such charge generating layer can form good images without blackspots in the white parts of papers at reverse development.

Preferred polyvinyl butyral has 50-80 mole percents, preferably 55-75 mole percents, more preferably 60-75 mole percents in butylation degree, 0-5 mole percents, preferably 0-3 mole percents, more preferably 0-2 mole percents in acetylation degree and 500-2000, preferably 700-1800, more preferably 800-1600 in polymerization degree. Polyvinyl butyral without butylation degree, acetylation degree and polymerization degree as above mentioned brings about such problems as bad dispersibility, increment of dark decay of surface potential and deterioration of repeating properties and sensitivity.

A charge generating layer with 0.1-0.5 μm, preferably 0.2-0.4 μm in thickness comprising polyvinyl butyral and metal-free phthalocyanine of $\tau$-form, modified $\tau$-form, $\eta$-form, modified $\eta$-form and a mixture thereof $\frac{1}{3}$-3/1 of weight ratio of the phthalocyanine to the butyral resin, preferably $\frac{1}{2}$-2/1 effects sensitivity, resistance to climate, resistance to adhesivity, durability, in particular, sensitivity of a photosensitive member. If the compounding ratio is more than 3/1, such problems as unsufficient adhesivity and application properties of a charge generating layer to a electrically conductive substrate are brought about. If the compounding ratio is less than $\frac{1}{3}$, such problems as the deterioration of sensitivity and the increment of residual potential of a photosensitive member. If the layer thickness is less than more than 0.5 μm, such problems as poor chargeability and thickness is the deterioration of surface potential are brought about when a photosensitive member is used repeatedly.

(CHARGE TRANSPORTING LAYER)

A charge transporting layer may be formed by the application and drying of a dispersion solution containing a charge transporting material and binder resin in an adequate solvent. Polymeric charge transporting materials which can be used as binder resin in itself may not need the other binder resin. Applicable as a binder in the practice of this invention are any of thermoplastic resins and thermosetting resins which are publicly known to be electrically insulative and any of photocuring resins and photoconductive resins.

Some examples of suitable binders are thermoplastic resins such as saturated polyester, polyamide, acrylic, ethylene-vinyl acetate copolymer, ion cross-linked olefin copolymer (ionomer), styrene-butadiene block copolymer, polyarylate, polycarbonate, vinyl chloride-vinyl acetate copolymer, cellulose ester, polyimide, styrol, etc., and thermosetting resins such as, epoxy, urethane, silicone, phenolic, melamine, xylene, alkyd, thermosetting acrylic, etc., and photocuring resins, and photoconductive resins such as poly-N-vinyl carbazole, polyvinyl pyrene, polyvinyl anthracene, etc., all named without any significance of restricting the use to them. Any of these resins can be used singly or in combination with other resins. It is desirable for any of these electrically insulative resins to have a volume resistance of $1\times10^{12}$ Ω·cm or more when measured singly. Preferably binder resin are polyester resin, polycarbonate, polyarylate, polyacryric resin.

A photosensitive member of the present invention permits, in combination with the binder, the use of a plasticizer, such as halogenated paraffin, polybiphenyl chloride, dimethyl naphthalene, dibutyl phthalate or O-terphenyl, the use of an electron-attractive sensitizer, such as chloranyl, tetracyanoethylene, 2,4,7-trinitrofluorenone, 5,6-dicyanobenzoquinone, tetracyanoquinodimethane, tetrachlorophthalic anhydride, or 3,5-dinitrobenzoic acid, and the use of a sensitizer, such as methyl violet, rhodamine B, cyanine dye, pyrylium salt, and thiapyrylium salt.

Illustrative examples of charge transporting materials are hydrazone compounds, pyrazoline compounds, styryl compounds, triphenylmethane compounds, oxadiazol compounds, carbazole compounds, stilbene compounds, enamine compounds, oxazole compounds, triphenylamine compounds, tetraphenylbenzidine, azine compounds and so on, including carbazole, N-ethylcarbazole, N-vinylcarbazole, N-phenylcarbazole, tethracene, chrysene, pyrene, perylene, 2-phenylnaphthalene, azapyrene, 2,3-benzochrysene, 3,4-benzopyrene, fluorene, 1,2-benzofluorene, 4-(2-fluorenylazo)-resorcinol, 2-p-anisolaminofluorene, p-diethylaminoazobenzene, cadion, N,N-dimethyl-p-fluoleneazoaniline, p-(dimethylamino)stilbene, 1,4-bis(2-methylstyryl)benzene, 9-(4-diethylaminostyrylanthracene, 2,5-bis(4-diethylaminophenyl)-1,3,5-oxadiazole, 1-phenyl-3-(p-diethylaminostyryl)-5-(p-diethylaminophenyl)pylazoline, 1-phenyl-3-phenyl-5-pylazolone, 2-(m-naphtyl)-3-phenyloxazole, 2-(p-diethylaminostyryl)-6-dietylaminobenzoxazole, 2-(p-diethylaminostyryl)-6-dietylaminobenzothiazole, bis(4-diethylamino-2-methylphenyl)phenylmethane, 1,1-bis(4-N,N-diethylamino-2-ethylphenyl)heptane, N,N-diphenylhydrazino-3-methylidene-10-ethylphenoxazine, N,N-diphenylhydrazino-3-methylidene-10-ethylphenothiazine, 1,1,2,2-tetrakis-(4-N,N-diethylamino-2-ethylphenyl)ethane, p-diethylaminobenzaldehyde-N,N-diphenylhydrazone, p-diphenylaminobenzaldehyde-N,N-diphenylhydrazone, N-ethylcarbazole-N-methyl-N-phenylhydrazone, p-diethylaminobenzaldehyde-N-α-naphthyl-N-phenylhydrazone, p-diethylaminobenzaldehyde-3-methylbenzothiazolinone-2-hydrazone, 2-methyl-4-N,N-diphenylamino-β-phenylstilbene, α-phenyl-4-N,N-diphenylaminostilbene, a hydrazone compound represented by the following general formula (I);

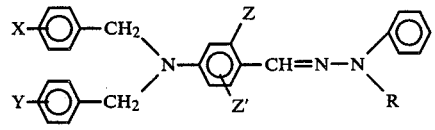

[I]

wherein X and Y independently represent hydrogen, a lower alkyl group, a methoxy group or an ethoxy group, Z represents a lower alkyl group, a benzyl group, a lower alkoxyl group, a phenoxy group or a benzyloxy group, Z' represents hydrogen, an alkyl group or an alkoxy group, R represents a lower alkyl group, an aryl group which may have substituents or a benzyl group, and so on. Any of these charge transporting materials can be singly or in combination with other resin.

It is found that, among these charge transporting materials, hydrazone compounds have good sensitivity but are liable to be vulnerable to photo-fatigue, caused by light with wavelength in the range of between the absorption band end and +50 nm thereof. Therefore, the present invention provides a means to prevent the photo-fatigue by the addition of dyes with maximum absorption wavelength in the range of 450–500 nm.

Any of orange colored dyes are generally suitable for the examples of the dyes with maximum absorption wavelength in the range of 450–500 nm, which may be selected from the group belonging to orange of color index such as Disperse Orange, Solvent Orange and so on.

These dyes are added at the amount of 0.1–10 percents by weight, preferably 1–5 percents by weights on the basis of hydrazone compounds.

If the amount of dyes is less than 0.1 percents by weight, sufficient effects can not be achieved. If the amount of dyes is more than 10 percents by weight, the movement of carriers in a charge transporting layer is disturbed and the sensitivity is deteriorated.

Dyes as above mentioned are particularly effective for hydrazone compounds represented by the following general formula (I);

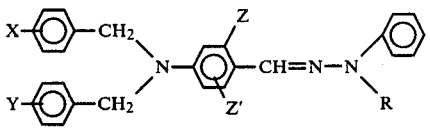

[I]

wherein X and Y independently represent hydrogen, a lower alkyl group, a methoxy group or an ethoxy group, Z represents a lower alkyl group, a benzyl group, a lower alkoxyl group, a phenoxy group or a benzyloxy group, Z' represents hydrogen, an alkyl group or an alkoxy group, R represents a lower alkyl group, an aryl group which may have substituents or a benzyl group.

A charge tranporting layer comprising hydrazone compounds represented by the general formula (I) and dyes with maximum absorption wavelength in the range of 450–500 nm can be provided a photosensitive member assured by good sensitivity and repeating properties and that not impaired, particularly at handling, by circumference lights.

X and Y in the compounds represented by the general formula (I) are respectively hydrogen; an alkyl group with 1–5 carbon numbers, preferably a methyl group or an ethyl group; a methoxy group; an ethoxy group, Z which is a substituents to benzene ring is an alkyl group with 1–5 carbon numbers, preferably a methyl group or an ethyl group; a benzyl group; a lower alkoxy group, preferably methoxy, ethoxy, propoxy; phenoxy; benzyloxy. Z' is hydrogen, an alkyl group, an alkoxy group, preferably hydrogen, a methyl group, an ethyl group, a methoxy group, an ethoxy group. R is preferably a methyl group, an ethyl group, a propyl group, an aryl group which may have a substituent, a benzyl group.

If X and Y are an alkyl group with more than five carbons, poor compatibility and poor solubility to resin and solvents are caused by the big molecular weight.

Hydrazone compounds represented by the general formula (I) must have Z substituent. The compounds without Z causes poor sensitivity and poor repeating properties.

If R is phenyl or benzyl, it may have an alkoxy substituent such as methoxy, ethoxy, etc. If R is hydrogen or have big molecular weight, such problems as poor sensitivity and compatibility with resin are brought about.

A charge transporting layer is formed by dispersing a hydrazone compound represented by the general formula as aforementioned into binder resin.

The thickness of a charge transporting layer is 5–50 μm, preferably 7–30 μm, more preferably 10–20 μm. A charge transporting layer with more than 50 μm in thickness causes poor sensitivity because lights are absorbed mostly in the charge tranporting layer. A charge transporting layer with less than 5 μm in thickness cannot have enough charge potential.

Preferred examples of hydrazone compounds are shown below with no significance of restricting the embodiments;

(1)

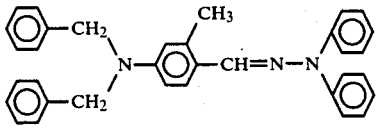

(2)

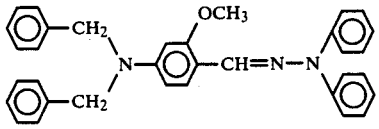

(3)

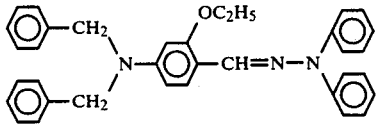

(4)

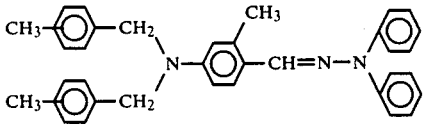

-continued (5)

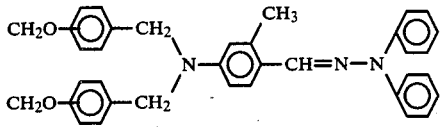

(6)

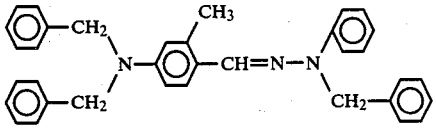

(7)

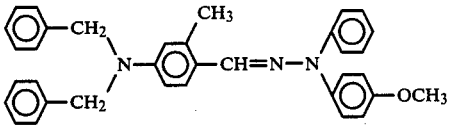

(8)

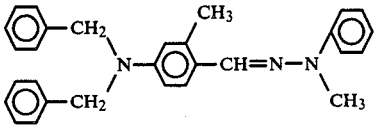

(9)

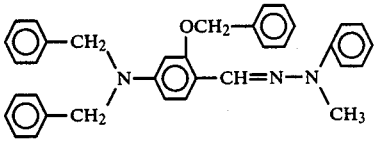

(10)

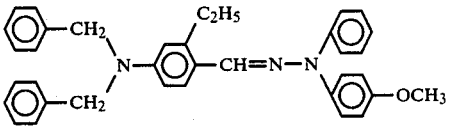

(11)

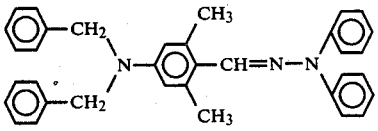

(12)

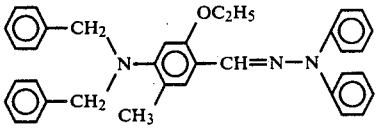

(13)

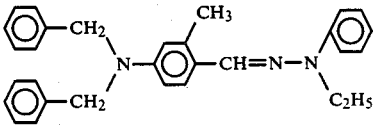

(14)

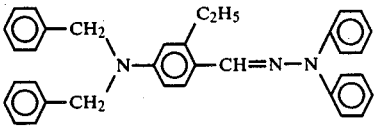

(15)

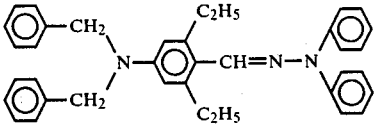

-continued (16)

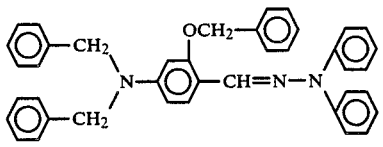

(17)

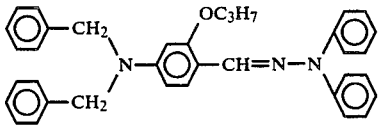

(18)

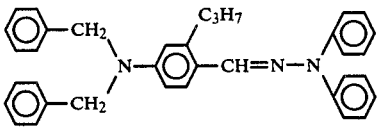

(19)

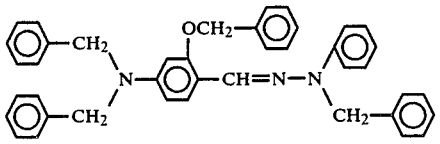

(20)

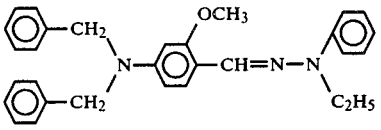

(21)

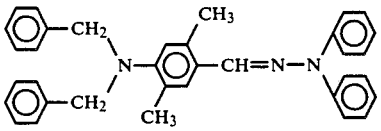

A function-divided photosensitive member in combination of a charge generating layer comprising polyvinyl butyral and metal-free phthalocyanine selected from the group consisting of $\tau$-form, modified $\tau$-form, $\eta$-form, modified $\eta$-form and a mixture thereof with a charge transporting layer comprising a hydrazone compound represented by the general formula (I) and a dye which have the light absorbing maximum in the range of 450–500 nm enjoys the effects of the invention given by each layer, and can be applied to a laser beam printer on account of good sensitivity in the range of long wavelength.

A hydrazone compound represented by the general formula (I) which is used in a photosensitive member of the invention can be synthesized according to a known method. For example, benzylaminobenzaldehyde represented by the following general formula (III);

[III]

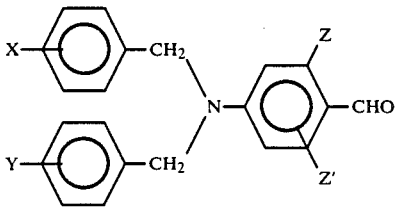

wherein X, Y, Z, Z' is the same as aforementioned, are mixed with a hydrazine compound or hydrochloric acid salt thereof represented by the following general formula (IV)

[IV]

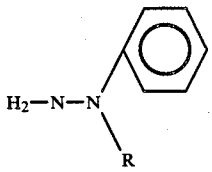

wherein R is the same as aforementioned, in an inactive organic solvent such as benzene, toluene, chlorobenzene, acetone, N,N-dimethylformamide, tetrahydrofuran, ethanol, etc. at the temperature of 20°–100° C., and both compounds are reacted together under refluxing.

A photosensitive member may have a charge generating layer and a charge transporting layer on an electrically conductive substrate in that order or may have a charge transporting layer and a charge generating layer on an electrically conductive substrate in that order.

Some examples of electrically conductive substrates used in a photosensitive member of the invention are sheets or drums prepared by foil or a plate of copper, aluminium, silver, iron and nickel etc., plastic films deposited in vacuum or electroless plated by metals above mentioned and substrates such as papers and plastic films on which electrically conductive compounds such as electrically conductive polymer, indium oxide, tin oxide etc. are deposited or dispersed.

A photosensitive member of the invention may have an adhesion layer or a barrier layer between a substrate and a photosensitive layer. Suitable examples contained in these layers are polyimide, polyamide, nitrocellulose, polyvinyl butyral, polyvinyl alcohol, aluminium oxide and so on. It is preferable that the thickness of the layer is 1 $\mu$m or less.

This invention is exemplified by examples.

(PREPARATION OF PHOTOSENSITIVE MEMBER)

Photosensitive members were prepared as described in Examples 1–14 and comparative Examples 1–7.

EXAMPLE 1

Metal free phthalocyanine of $\tau$-form of 1 part by weight and polyvinyl butyral resin (3 mole % or less of acetylation degree, 68 mole % of butylation degree, 1500 of polymerization degree) of 1 part by weight and cyclohexanone of 100 parts by weight were taken into a ball mill pot and dispersed for 24 hours to prepare a dispersion solution.

The dispertion solution was applied to an aluminium substrate to form a charge generating layer of 0.3 $\mu$m in thickness after dried.

A coating solution containing 10 parts by weight of hydrazone compound represented by the structural formula (2) below;

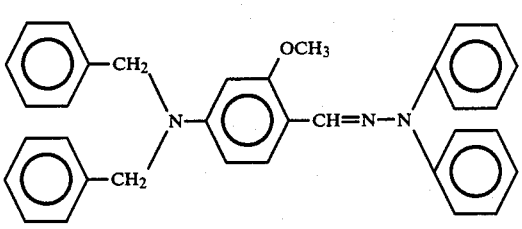

(2)

and 10 parts by weight of polycarbonate resin (Panlite K-1300; made by Teijin Kasei K.K.) in 180 parts by weight of tetrahydrofuran was applied on the charge generating layer to form a charge transporting layer of 15 μm in thickness after dried. Thus, a photosensitive member was obtained.

EXAMPLE 2-5

Photosensitive members were prepared in a similar way as the Example 1 except that the thickness of charge generating layers were 0.1 μm, 0.2 μm, 0.4 μm, 0.5 μm respectively.

EXAMPLE 6-7

Photosensitive members were prepared in a similar way as the Example 1 except that 3 parts by weight and 0.4 part by weight of polyvinyl butyral resin were used.

EXAMPLE 8

Metal free phthalocyanine of τ-form of 1 part by weight and polyvinyl butyral resin (3 mole % or less of acetylation degree, 70 mole % of butylation degree, 1000 of polymerization degree) of 2 parts by weight and tetrahydrofuran of 100 parts by weight were taken into a ball mill pot and dispersed for 24 hours to prepare a dispersion solution. The dispertion solution was applied to an aluminium substrate to form a charge generating layer of 0.4 μm in thickness after dried.

A coating solution containing 8 parts by weight of hydrazone compound represented by the structural formula (1) below;

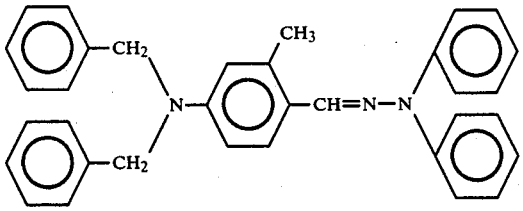

(1)

0.1 part by weight of Solvent Orange 40 dye (Sumiplast Orange 12, made by Sumitomo Kagaku K.K) with absorption maximum in the range of 450-500 nm and 10 parts by weight of polycarbonate resin (Panlite L-1250; made by Teijin Kasei K.K.) in 180 parts by weight of tetrahydrofuran was applied on the charge generating layer to form a charge transporting layer of 15 μm in thickness after dried. Thus, a photosensitive member was obtained.

COMPARATIVE EXAMPLE 1

A photosensitive member was prepared in a similar way as the Example 1 except that the thickness of charge generating layers was 1 μm.

COMPARATIVE EXAMPLE 2

A photosensitive member was prepared in a similar way as the Example 1 except that 4 parts by weight of polyvinyl butyral resin was used.

COMPARATIVE EXAMPLE 3

A photosensitive member was prepared in a similar way as the Example 1 except that 0.2 part by weight of polyvinyl butyral resin was used.

COMPARATIVE EXAMPLE 4

A photosensitive member was prepared in a similar way as the Example 1 except that epoxy-modified silicon resin(KR-5240 made by Shin-etsu Kagaku K.K) instead of polyvinyl butyral resin.

COMPARATIVE EXAMPLE 5

A photosensitive member was prepared in a similar way as the Example 1 except that polyester resin (Vylon 200 made by Toyobo K.K.) instead of polyvinyl butyral resin.

EXAMPLE 9

Metal free phthalocyanine of τ-form of 1 part by weight and polyvinyl butyral resin (3 mole % or less of acetylation degree, 68 mole % of butylation degree, 750 of polymerization degree; S-Lec BM-2, made by Sekisui Kagaku Kogyo K.K.) of 1 part by weight and cyclohexanone of 100 parts by weight were taken into a ball mill pot and dispersed for 24 hours to prepare a dispersion solution. The dispertion solution was applied to an aluminium substrate to form a charge generating layer of 0.3 μm in thickness after dried.

A coating solution containing 10 parts by weight of hydrazone compound represented by the structural formula (1) below;

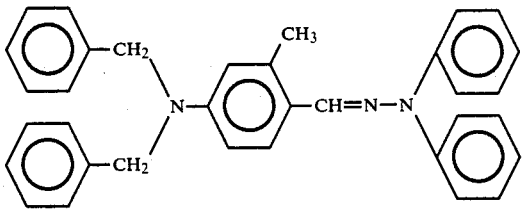

(1)

0.1 part by weight of Solvent Orange 80 dye (Kayaset Orange G; made by Nippon Kayaku K.K.) with absorption maximum in the range of 450-500 nm and 10 parts by weight of polycarbonate resin (Panlite K-1300; made by Teijin Kasei K.K.) in 180 parts by weight of tetrahydrofuran was applied on the charge generating layer to form a charge transporting layer of 15 μm in thickness after dried. Thus, a photosensitive member was obtained.

Figure 3:
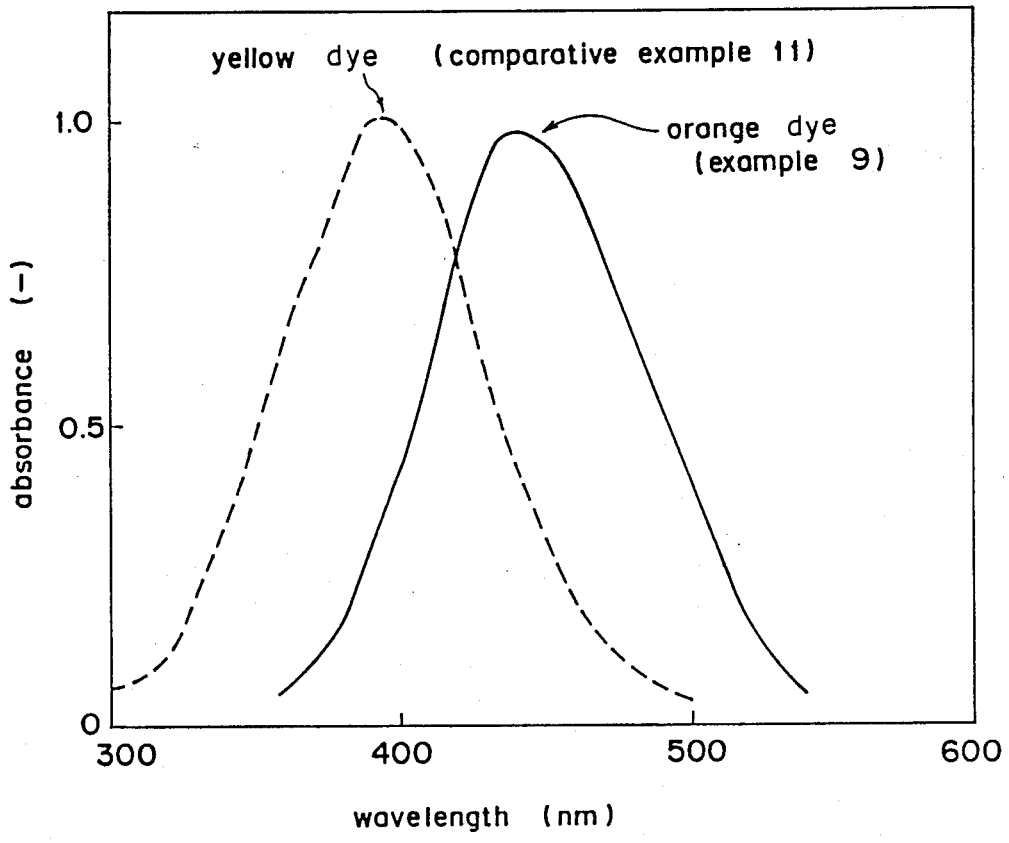
FIG. 3 shows the absorption spectra of dyes used in Example 9 and Comparative Example 11.

The absorption spectrum of the dye used in the example was shown in FIG. 3.

EXAMPLE 10-12

Photosensitive members were prepared in a similar way as the Example 9 except that 0.2 part by weight, 0.4 parts by weight and 0.6 part by weight of the dye were used.

EXAMPLE 13

Metal free phthalocyanine of $\tau$-form of 1 part by weight and polyvinyl butyral resin (3 mole % or less of acetylation degree, 55 mole % of butylation degree, 1100 of polymerization degree; S-Lec BX-1, made by Sekisui Kagaku Kogyo K.K.) of 2 parts by weight and tetrahydrofuran of 100 parts by weight were taken into a ball mill pot and dispersed for 24 hours to prepare a dispersion solution.

The dispertion solution was applied to an aluminium substrate to form a charge generating layer of 0.4 $\mu$m in thickness after dried.

A coating solution containing 8 parts by weight of hydrazone compound represented by the structural formula (2) below;

(2)

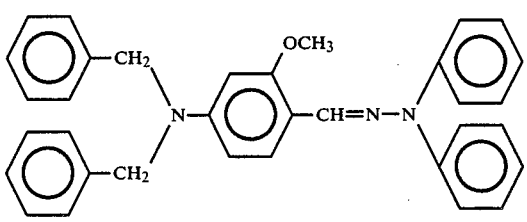

0.1 part by weight of Solvent Orange 40 dye (Sumiplast Orange 12; made by Sumitomo Kgaku K.K.) with absorption maximum in the range of 450–500 nm and 10 parts by weight of polycarbonate resin (Panlite L-1250; made by Teijin Kasei K.K.) in 180 parts by weight of tetrahydrofuran was applied on the charge generating layer to form a charge transporting layer of 15 $\mu$m in thickness after dried. Thus, a photosensitive member was obtained.

EXAMPLE 14

A photosensitive member was prepared in a similar way as the Example 13 except that hydrazone compound represented by the structural formula (3) below;

(3)

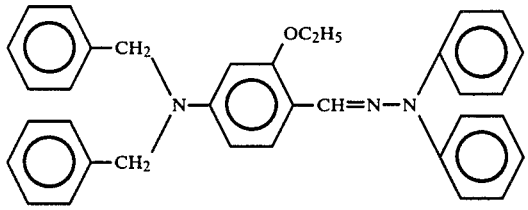

was used instead of hydrazone compound represented by the structural formula (2).

EXAMPLE 15

Metal free phthalocyanine of $\eta$-form of 1 part by weight and polyvinyl butyral resin (2 mole % or less of acetylation degree, 70 mole % of butylation degree, 1300 of polymerization degree) of 1 part by weight and cyclohexanone of 100 parts by weight were taken into a ball mill pot and dispersed for 24 hours to prepare a dispersion solution.

The dispertion solution was applied to an aluminium substrate to form a charge generating layer of 0.4 $\mu$m in thickness after dried.

A coating solution containing 12 parts by weight of hydrazone compound represented by the structural formula (14) below;

(14)

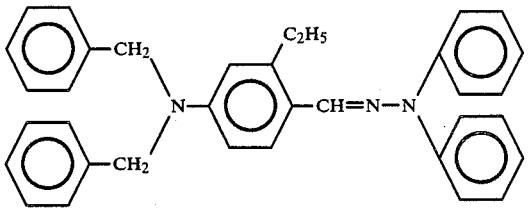

0.05 part by weight of Solvent Orange 60 dye (Sumiplast Orange HRP; made by Sumitomo Kagaku K.K.) with absorption maximum in the range of 450–500 nm and 10 parts by weight of polycarbonate resin (Panlite K-1300; made by Teijin Kasei K.K.) in 200 parts by weight of tetrahydrofuran was applied on the charge generating layer to form a charge transporting layer of 15 $\mu$m in thickness after dried. Thus, a photosensitive member was obtained.

EXAMPLE 16

Metal free phthalocyanine of modified $\tau$-form of 1 part by weight and polyvinyl butyral resin (3 mole % or less of acetylation degree, 55 mole % of butylation degree, 2000 of polymerization degree) of 3 parts by weight and cyclohexanone of 100 parts by weight were taken into a ball mill pot and dispersed for 24 hours to prepare a dispersion solution.

The dispertion solution was applied to an aluminium substrate to form a charge generating layer of 0.5 $\mu$m in thickness after dried.

A coating solution containing 10 parts by weight of hydrazone compound represented by the structural formula (21) below;

(21)

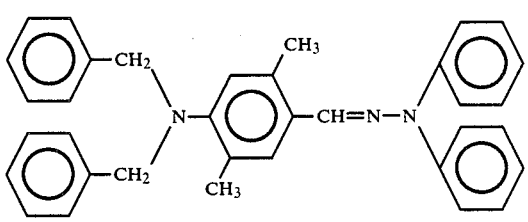

0.1 part by weight of Solvent Orange 80 dye (Kayaset Orange G; made by Nippon Kayaku K.K.) with absorption maximum in the range of 450–500 nm and 10 parts by weight of polyarylate resin (APEC,KLl; made by Bayer Co., Ltd.,) in 200 parts by weight of tetrahydrofuran was applied on the charge generating layer to form a charge transporting layer of 20 $\mu$m in thickness after dried. Thus, a photosensitive member was obtained.

EXAMPLE 17

Metal free phthalocyanine of modified $\eta$-form of 3 part by weight and polyvinyl butyral resin (2 mole % or less of acetylation degree, 60 mole % of butylation degree, 1300 of polymerization degree) of 1 part by weight and tetrahydrofuran of 100 parts by weight were taken into a ball mill pot and dispersed for 24 hours to prepare a dispersion solution.

The dispertion solution was applied to an aluminium substrate to form a charge generating layer of 0.2 μm in thickness after dried.

A coating solution containing 10 parts by weight of hydrazone compound represented by the structural formula (1) below;

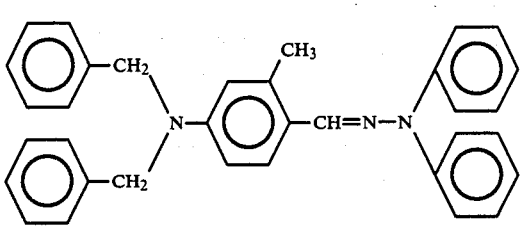

(1)

0.5 part by weight of Solvent Orange 40 dye (Sumiplast Orange 12; made by Sumitomo Kagaku K.K.) with absorption maximum in the range of 450–500 nm and 10 parts by weight of polyarylate resin (APEC,KL1; made by Bayer Co., Ltd.,) in 200 parts by weight of tetrahydrofuran was applied on the charge generating layer to form a charge transporting layer of 20 μm in thickness after dried. Thus, a photosensitive member was obtained.

COMPARATIVE EXAMPLE 6

Metal free phthalocyanine of τ-form of 1 part by weight and polyester resin (Vylon 200; made by TOYOBO K.K.) of 2 parts by weight and tetrahydrofuran of 100 parts by weight were taken into a ball mill pot and dispersed for 24 hours to prepare a dispersion solution.

The dispertion solution was applied to an aluminium substrate to form a charge generating layer of 0.3 μm in thickness after dried.

A coating solution containing 8 parts by weight of hydrazone compound represented by the structural formula (2) below;

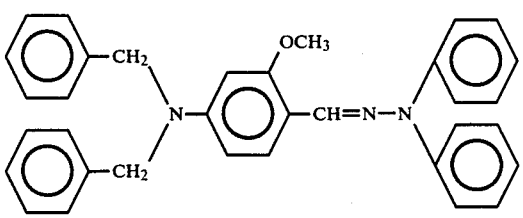

(2)

0.1 part by weight of Solvent Orange 40 dye (Sumiplast Orange 12; made by Sumitomo Kagaku K.K.) with absorption maximum in the range of 450–500 nm and 10 parts by weight of polycarbonate resin (Panlite L-1250; made by Teijin Kasei K.K.) in 180 parts by weight of tetrahydrofuran was applied on the charge generating layer to form a charge transporting layer of 15 μm in thickness after dried. Thus, a photosensitive member was obtained.

COMPARATIVE EXAMPLE 7

A photosensitive member was prepared in a similar way as Comparative Example 6 except that 1 part by weight of the dye was used.

COMPARATIVE EXAMPLE 8

A photosensitive member was prepared in a similar way as Comparative Example 6 except that the dye was not

COMPARATIVE EXAMPLE 9–12

A photosensitive members were prepared in a similar way as Example 9 except that the dyes were used below;

COMPARATIVE EXAMPLE 9

Ultraviolet Absorbent(triazole; Viosorb-550; made by Kyodo Yakuhin K.K.).

COMPARATIVE EXAMPLE 10

Solvent Yellow 14; made by BASF Co., Ltd.,

COMPARATIVE EXAMPLE 11

Sumiplast Yellow C; made by Sumitomo Kagaku K.K.

The absorption spectrum of the pigment was shown in FIG. 3.

COMPARATIVE EXAMPLE 12

Disperse Yellow Y-54; made by Sumitomo Kagaku K.K.

EVALUATION

Resultant photosensitive members were charged by means of corona-discharge of −6 KV with a electrophotographic copier (EP-470Z, made by Minolta Camera K.K.) to measure initial surface potential (V), exposure value for half reducing ($E_{\frac{1}{2}}$ (lux.sec)). which is a necessary exposure amount for the surface potential to be the half value of the initial surface potential, decay ratio ($DDR_1$ (%)), which is the reduction of ratio of the initial surface potential for 1 second in the dark.

The obtained results were shown in Table 1.

TABLE 1

| | $V_O$(V) | $E_{\frac{1}{2}}$(lux.sec) | $DDR_1$(%) |
|---|---|---|---|
| Example 1 | 630 | 1.8 | 8.0 |
| Example 2 | 740 | 2.4 | 6.5 |
| Example 3 | 650 | 2.0 | 7.5 |
| Example 4 | 590 | 1.7 | 8.5 |
| Example 5 | 530 | 1.6 | 10.0 |
| Example 6 | 640 | 2.0 | 8.0 |
| Example 7 | 510 | 1.5 | 17.0 |
| Example 8 | 620 | 1.8 | 7.5 |
| Comparative Example 1 | 250 | 0.4 | 21.0 |
| Comparative Example 2 | 720 | 2.8 | 6.5 |
| Comparative Example 3 | 210 | 0.3 | 25.0 |
| Comparative Example 4 | 650 | 2.6 | 7.5 |
| Comparative Example 5 | 600 | 3.2 | 8.5 |
| Example 9 | 620 | 1.8 | 8.0 |
| Example 10 | 610 | 1.8 | 8.0 |
| Example 11 | 620 | 1.9 | 8.5 |
| Example 12 | 620 | 2.1 | 9.0 |
| Example 13 | 630 | 1.7 | 7.5 |
| Example 14 | 620 | 1.8 | 8.0 |
| Example 15 | 630 | 2.2 | 7.3 |
| Example 16 | 620 | 1.9 | 8.0 |
| Example 17 | 630 | 2.3 | 7.8 |
| Comparative Example 6 | 620 | 3.8 | 8.0 |
| Comparative Example 7 | 630 | 5.4 | 6.0 |
| Comparative Example 8 | 620 | 3.5 | 7.5 |
| Comparative Example 9 | 620 | 2.2 | 7.5 |
| Comparative Example 10 | 625 | 2.5 | 8.0 |
| Comparative Example 11 | 640 | 3.8 | 7.0 |
| Comparative Example 12 | 630 | 2.7 | 8.0 |

As regards photosensitive members of Example 1, Example 8, Comparative Example 4 and Comparative Example 5, black spots in while parts of papers and white spots in black devoloped parts in papers were evaluated when those photosensitive members were developed reversely in the condition of $V_0 = -750$ V and $V_b$ (bias voltage for development) $= -500$ V. The results were shown in Table 2, wherein G, US and P mean good, unsufficient and poor respectively.

TABLE 2

| | Black spot | White spot |
|---|---|---|
| Example 1 | G | G |
| Example 8 | G | G |
| Comparative Example 4 | US | G |
| Comparative Example 5 | P | US |

Further, other photosensitive properties about photosensitive members obtained in Examples 9–14 and Comparative Examples 6–7 were measured with a tester for photosensitive member which had similar constitution as a copier (FIG. 1).

The tester was equipped with a resultant photosensitive member on a drum for photosensitive member (110) to measure initial surface potential ($V_0$) of photosensitive member, which is the voltage at the time when 0.3 second passed after the photosensitive member was charged to about 500 V with a charger (111), surface potential (Vi), which is the voltage after the charged photosensitive member was exposed to white light (112) generated by halogen lamp, residual potential (Vr), which is the voltage after residual charges on the photosensitive member was removed by a light eraser (114). $V_0$, Vi, Vr were measured by a probe (113).

Photosensitive properties before light irradiation and those after light irradiation were evaluated with the above mentioned tester. The light irradiation means that a photosensitive member was left under 500 lux of fluorescent light for 10 minutes. The photosensitive properties after the light irradiation were measured immediately after the light irradiation and after the above mentioned processes for the tester were repeatedly 100 times. The results were shown in Table 3.

TABLE 3

| | before irradiation(-V) | | | immediately after irradiation(-V) | | | repeated 100 times after irradiation(-V) | | |
|---|---|---|---|---|---|---|---|---|---|
| | $V_O$ | Vi | Vr | $V_O$ | Vi | Vr | $V_O$ | Vi | Vr |
| E9 | 510 | 150 | 10 | 500 | 145 | 25 | 525 | 170 | 35 |
| E10 | 510 | 160 | 10 | 510 | 170 | 20 | 520 | 170 | 30 |
| E11 | 500 | 160 | 10 | 505 | 170 | 20 | 500 | 165 | 30 |
| E12 | 510 | 170 | 10 | 505 | 170 | 15 | 510 | 160 | 25 |
| E13 | 510 | 150 | 10 | 505 | 145 | 20 | 515 | 160 | 25 |
| E14 | 510 | 160 | 10 | 500 | 155 | 15 | 510 | 170 | 25 |
| E15 | 515 | 170 | 15 | 510 | 160 | 25 | 520 | 170 | 30 |
| E16 | 510 | 150 | 10 | 505 | 160 | 20 | 510 | 160 | 25 |
| E17 | 515 | 180 | 15 | 505 | 170 | 25 | 520 | 185 | 30 |
| CE6 | 510 | 270 | 25 | 470 | 240 | 15 | 480 | 265 | 35 |
| CE7 | 520 | 320 | 50 | 460 | 290 | 50 | 450 | 320 | 60 |
| CE8 | 510 | 250 | 20 | 450 | 270 | 75 | 620 | 380 | 140 |
| CE9 | 500 | 170 | 20 | 460 | 260 | 80 | 600 | 380 | 150 |
| CE10 | 515 | 210 | 25 | 530 | 390 | 150 | 630 | 410 | 190 |
| CE11 | 525 | 260 | 50 | 450 | 310 | 90 | 600 | 400 | 180 |
| CE12 | 520 | 220 | 30 | 460 | 230 | 60 | 590 | 330 | 140 |

E;example,
CE;comparative example

It is understood that a photosensitive member of the invention comprising dyes in a charge transporting layer can provide good images without foggings resulted from the increment of residual potential or surface potential when used repeatedly and white spots resulted from the decrease of surface potential, even after irradiated by, for example, circumference lights. A photosensitive member of the invention can be easily handled in the light because light fatigue is restrained.

Further, a photosensitive member of the invention keep good properties when used in, in particularly, LED printer or LD printer, because dyes does not works as a light filter.

What is claimed is:

1. A function-divided photosensitive member which has a charge generating layer and a charge transporting layer on an electrically conductive substrate, wherein the charge generating layer comprises polyvinyl butyral and metal-free phthalocyanine selected from the group consisting of T-form, modified $\tau$-form, $\eta$-form, modified $\eta$-form and a mixture thereof and the charge transporting layer comprises a hydrazone compound represented by the following general formula (I) and a dye which has the light absorbing maximum in the range of from 450 to 500 nm;

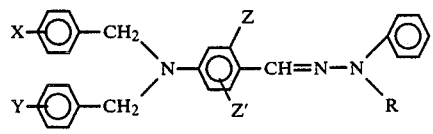

[I]

wherein x and y independently represent hydrogen, a lower alkyl group, a methoxy group or an ethoxy group, z represents a lower alkyl group, a benzyl group, a lower alkoxyl group, a phenoxy group or a benzyloxy group, Z, represents hydrogen, an alkyl group or an alkoxy group, R represents a lower alkyl group, an aryl grouI which may have substituents or a benzyl group;

the weight ratio of the metal-free phthalocyanine to butyral rising being from $\frac{1}{3}$ to 3/1;

the olyvinyl butyral resin having from 50 to 80 mole percent in butylation degree, from 0 to 5 percent in acetylation degree and from 500 to 2000 in polymerization degree;

the charge generating layer being from 0.1 to 0.5 $\mu$min thickness;

the charge transporting layer being from 5 to 50 $\mu$min thickness; and the dye being connected at from 0.1 to 10 percent by weight on the basis of the hydrazone compound.

2. A function-divided photosensitive member of claim 1 comprising the hydrazone compound represented by the general formula wherein X, Y and Z' are hydrogen, Z is a methyl group, an ethyl group, a methoxy group oran ethoxy group, and R is a phenyl group.

3. A function-divided photosensitive member of claim 1, wherein the dye is Solvent Orange 80, Solvent Orange 40, or Solvent Orange 60.

4. A function-divided photosensitive member of claim 1, :wherein the charge generating layer compıises $\tau$-form metal-free phthalocyanine.

5. The function-divided photosensitive member of claim 1, wherein the charge transporting layer comprises the hydrazone compound at the weight ratio of from $\frac{1}{2}$ to 6/5 to a binder resin.

* * * * *